United States Patent [19]

Ritopecki

[11] 4,210,120

[45] Jul. 1, 1980

[54] FURNACE PEEP SIGHT

[76] Inventor: Branco Ritopecki, 959 Mohawk Rd., E., Hamilton, Ontario, Canada, L8T 2R9

[21] Appl. No.: 933,740

[22] Filed: Aug. 15, 1978

[51] Int. Cl.[2] ..... F23M 7/00

[52] U.S. Cl. ..... 126/200

[58] Field of Search ..... 126/200; 110/173 R; 432/250; 266/100; 49/171

[56] References Cited

U.S. PATENT DOCUMENTS

| | | | |
|---|---|---|---|
| 846,475 | 3/1907 | Hosking | 126/200 X |
| 1,349,562 | 8/1920 | Curry | 126/200 |
| 3,800,716 | 4/1974 | Berger | 126/200 |
| 3,859,041 | 1/1975 | Winslow | 126/200 |

*Primary Examiner*—Samuel Scott
*Assistant Examiner*—Gerry Anderson
*Attorney, Agent, or Firm*—Robert D. Farkas

[57] ABSTRACT

A furnace peep sight utilizes a pair of glass plates removeably mounted within passageways of a truncated conical body journaled for rotation and partly mounted within the wall of a furnace. A passageway, useful for sighting purposes, passes through both of the glass plates extending transverse to the longitudinal axis of the body so as to position, in one angular location of the body, one of the glasses inwardly towards the interior of the furnace and the other glass plate located outwardly from the exterior surface of the wall. Further rotation of the body permits the glass plates to be aligned transverse to a sight hole otherwise coaxially aligned the openings in the body.

7 Claims, 2 Drawing Figures

FURNACE PEEP SIGHT

BACKGROUND OF THE INVENTION

1. The Field of the Invention

This invention relates to furnace peep sights and more particularly to that class of apparatus which provides double sight glass protection between the viewer and the interior of the furnace and embodies an apparatus capable of closing off the interior of the furnace from view from a position from without the furnace.

2. Description of the Prior Art

The prior art abounds with furnace peep sights. U.S. Pat. No. 2,387,133 issued Oct. 16, 1945 to C. Foster teaches a peep hole box, utilizing water cooling for purposes of maintaining the orifice of the box at a cool temperature. Such orifice is removeably covered by a pivotable cover plate which when pivoted away from the orifice permits access therethrough thus providing an orifice which may be protected with the glass plate, if desired, or may be suitable for the insertion of test probes or other devices. However, the Foster apparatus becomes totally useful in the event that the glass plate shatters or is not employed by enabling heated gases to emerge outwardly from the orifice despite the walls of the orifice being in a cooled condition.

U.S. Pat. No. 2,112,063 issued Mar. 22, 1938 to J. Blizard discloses a peep sight for furnaces having particular use in double walled furnaces wherein the cavity separating the walls is operated at high pressure levels. The Blizard peep sight includes an elongated passageway traversing the double walled chamber and having at the exterior end thereof a hatchway, which when opened, permits the user to peer into the chamber traversing passageway. Coupled to the hatch is a shaft which in turn has a plate affixed thereto. This plate extends between the end of the chamber traversing passageway and the entrance opening into the furnace. Thus, when the hatch is moved so as to open a viewer end of the passageway, the plate is positioned such that an opening therein is juxtaposed over the entranceway into the interior of the furnace. The Blizard apparatus unfortunately couples the interior of the furnace directly to the users eye, excepting for the capability of inserting a glass or mica plate at any location along the length of the communicating passageway or at the ends thereof. Obviously, replacement of the transparent plate becomes exceedingly difficult and if ruptured or cracked fails to provide protection to the eyes of the user.

U.S. Pat. No. 1,973,171 issued Sept. 11, 1934 to W. H. Jacobi describes a furnace peep sight in which a plurality of elements are separately pivotably adapted to cover an opening in the sight. One of such coverings comprises a solid plate, the other comprises a screen. If desired, one of the pivotable plates may be fabricated having a transparent rigid substance, such as heat resistant glass or mica. However, in the event the user is employing such a transparent rigid plate and the plate cracks or becomes broken, the users eye is immediately subjected to the interior high temperature gases emerging outwardly from the interior of the furnace and through such crack or broken transparent plate.

SUMMARY OF THE INVENTION

A primary object of the present invention is to provide a peep sight for a furnace in which the user thereof is protected against injury in the event of the accidental breakage, cracking or deterioration of a sight glass.

Another object of the present invention is to provide a double glass peep sight wherein both glasses are interposed between the interior of the furnace and the users eye, in a use position, thereby protecting the eyes of the user against injury.

Still another object of the present invention is to provide a peep sight wherein the externally located sight glass is maintained close to the ambient temperature in which the user resides.

Yet another object of the present invention is to provide a sight apparatus for furnaces wherein at least one glass is always located intermediate the interior of the furnace and the exterior thereof when a damaged glass is removed for replacement.

A further object of the present invention is to provide a peep sight for furnaces which have the capability of placing a substantial thickness of metallic material between the interior and exterior of the furnace, closing off the interior of the furnace, when desired.

Another object of the present invention is to provide a peep sight for furnaces which is inexpensive to manufacture, durable in construction, being fabricated from inexpensive materials and easily mounted to existent furnaces.

Heretofore, furnace peep sights served a variety of functions. Amongst these are an open passageway extending from the exterior of the furnace to the interior portion thereof, coverable by a variety of elements. These elements include permanently installed sight glasses, fabricated either from high temperature glass, mica or the like, removeable metallic plates, screens and the like, each used separately or in combination with one another. In blast furnaces, or other furnaces having exceedingly high temperatures in the interior regions thereof, it is imperative that the sight opening be safely covered so as to preclude the possibility of high temperature gases or other high temperature materials from emerging outwardly through the sight passageway so as to endanger the eyes, face or hands of a viewer. Further, it is quite often necessary to effectively close the end of the passageway so as to preclude the possibility of materials, contained within the furnace, from emerging outwardly therefrom. It is also highly desirable to maintain the sight glass at a low temperature so as to preclude or minimize the possibility of the glass cracking or being destroyed by being exposed to the high temperatures emanating from the interior of the furnace. Replacement of the sight glass, on a periodic or emergency basis, should be convenient and easily accomplished, despite the fact that the furnace may be in operation. Finally, it is highly desirable to have a substantial thickness of metal interposed between the interior of the furnace and the exterior thereof when the sight glass is not in use. Changing the covering of the passageway from a solid, heat resistant material to a transparent material requires the use of bearings. Obviously, the number of bearings or bearing surfaces should be minimized since each of such bearings require maintenance and represent a substantial construction problem due to the high temperature involved.

The present invention recognizes these goals and provides a ready solution therefor by providing a pair of sight glasses disposed in axial alignment having a single rotary mount to the wall of a furnace. When both sight glasses are disposed so as to have their lateral surfaces extend transverse to the wall of the furnace, a substantial amount of metallic material closes off the passageway communicating to the interior of the furnace. When moved ninety degrees, in either direction, both sight glasses are extended transverse to the passageway providing double protection therefor, disposing one of the glasses outwardly from the exterior surface of the furnace, maintaining same at a low ambient temperature and permitting same to be easily replaced whilst maintaining the other sight glass in an operational position. In this fashion, the minimum amount of bearing element is employed and double sight glass protection is afforded the user at all times that the sighting operation is to take place. Because of its simple construction, the present invention may be added to existent furnaces or installed as a new construction or as original equipment of the furnace.

These objects as well as other objects of the present invention will become more readily apparent after reading the following description of the accompanying drawings.

DESCRIPTION OF THE PREFERRED EMBODIMENT

Figure 1:
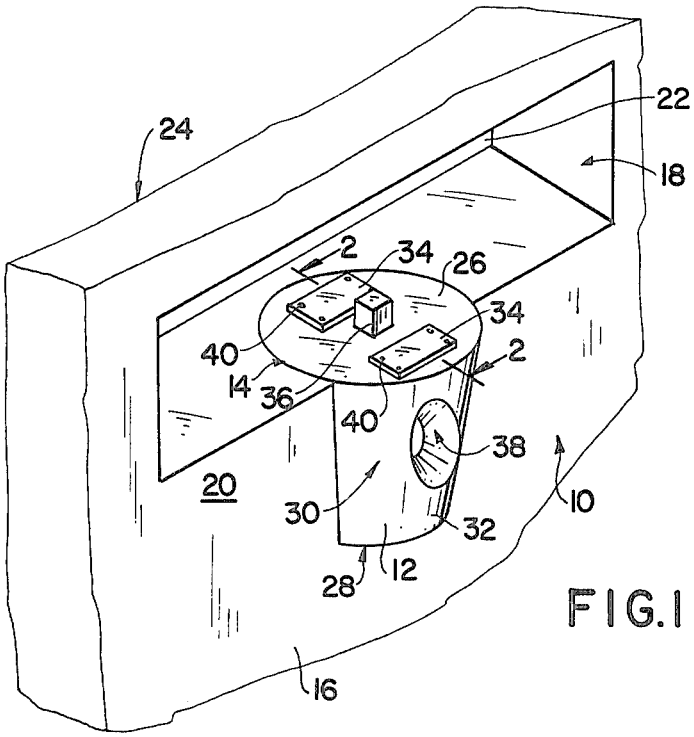
FIG. 1 is a perspective view of the present invention shown installed in a portion of a furnace wall.

The structure and method of fabrication of the present invention is applicable to a truncated conical body having a passageway extending from opposite walls thereof normal to the longitudinal axis of the body. A pair of passageways have open mouth portions in the base of the body and extend in planes, disposed in spaced apart relationship, parallel to one another, and opposite sides from the longitudinal axis of the body. The apex of the body is provided with a protrusion, acting as a bearing therefor. Another protrusion is located on the base of the body disposed intermediate the open mouth portions of the spaced apart passageways. The sighting passageway is preferably tapered so as to have the external openings thereof larger in diameter than the portions thereof intercepting a rectangular-like glass receiving passageway. A pair of cover plates are disposed covering the open mouth portion of the glass receiving passageways in which mica, glass plates, either clear or translucent in nature, may be located. The base of the body is installed in an upper position, relative to the apex thereof in the wall of a furnace, preferably below a rectangular-like opening partially extending in the wall of the furnace. The region of the wall of the furnace located beneath the rectangular cavity is shaped so as to be complementary to the truncated conical surface of the body such that a portion of the body extends outwardly from the exterior surface of the furnace. A wrench may be utilized to rotate the body so as to position the sight passageway normal to the wall of the furnace. The remaining portions of the wall of the furnace, separating the body and the interior of the surface is provided with a sight passageway which may be coaxially aligned with the sight passageway of the body when the body is rotated so as to dispose the planes of the sight glass transverse to the sight passageway located in the wall of the furnace. When the body is rotated ninety degrees from the sighting position, the sight passageway in the wall of the furnace is blocked off by the central regions of the body located intermediate glass containing passageways. The body is preferably fabricated from steel, including its two protrusions. The two cover plates may be secured utilizing bolts therefore and are preferably fabricated from steel as well. The sight glasses may be replaced by simply inserting a screwdriver or other long tool into the exposed peep hole forcing the glass upwardly toward the open mouth portion of the glass receiving passageway, after the cover plate thereof is removed. Rotating the body one hundred eighty degrees aligns the other sight glass passageway to a position where its sight glass may be easily replaced. Thus, in all angular rotations of the body, at least one sight glass is interposed between the interior of the furnace and the exterior regions thereof. If the cavity located above the body, in the wall of the furnace is of adequate size, the sight glasses may be replaced whilst the body blocks the outermost end of the sight passageway located in the wall of the furnace.

Now referring to the figures, and more particularly to the embodiment illustrated in FIG. 1 showing the present invention 10, having truncated conical body 12 installed in a semi-truncated opening 14 in furnace wall 16. Cavity 18 is disposed in furnace wall 16 extending inwardly from outermost surface 20 thereof. Innermost surface 22 comprises a solid wall separating interior surface 24 of a heat containing furnace. Base 26 of body 12 is shown in an uppermost position relative to apex portion 28 thereof. Exterior surface 30, of body portion 12, has a portion 32 thereof extending outwardly from surface 20. Cover plates 34 are secured to base 26. Protrusion 36 extends upwardly from base 26 and is shown to have a rectangular shape. Sight hole opening 38 is located in portion 32 of surface 30. Screws 40 are used to secure cover plates 34 to base 26. It should be noted that body 12 may be cylindrical in nature, in which case opening 14 would define semi-circular walls. If such be the case, base 26 and apex 28 would be equi-dimensioned.

Figure 2:
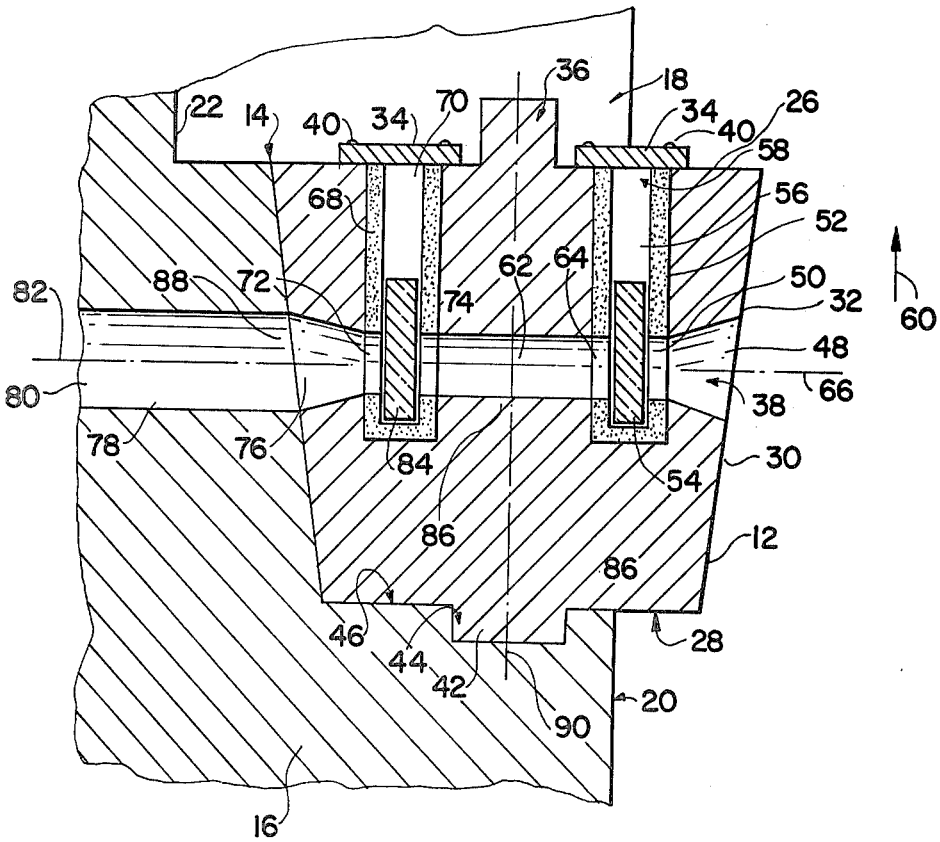
FIG. 2 is a side elevation, cross-sectional view, taken along lines 2—2, viewed in the direction of arrows 2—2 of the apparatus shown in FIG. 1.

FIG. 2 illustrates body 12 shown having another protrusion 42 residing in opening 44 in wall 16 of the furnace. Protrusion 42 acts as a bearing so as to maintain apex 28 in lateral alignment with supporting surface 46 of wall 20. Passageway 48 is shown having a truncated shape adjacent opening 38, tapering downwardly in size as the length of the passageway approximates opening 50 in insulator lining 52. Lining 52, having planar sight glass 54 disposed in glass receiving passageway 56 thereof, may be fabricated from a heat resistant material, such as a cementious asbestos bearing compound. When cover 34 is removed, open mouth portion 58, of passageway 56 is exposed permitting sight glass 54 to be moved upwardly in a direction of arrow 60. Body 12 is provided with internal passageway 62, communicating with opening 64 in lining 52, and is coaxially aligned with longitudinal axis 66 of passageway 48. Lining 68 is provided with passageway 70 and openings 72 and 74 coaxially aligned with passageway 76 and passageway 62. It is to be noted that passageway 76 is similarly shaped to passageway 48. Wall 20 is provided with passageway 78 having end 80 thereof communicating to the interior of the furnace. Thus, when longitudinal axis 66 is coaxially aligned with longitudinal axis 80, the longitudinal axis of passageway 78, a clear view may be attained by peering in opening 38 through sight glass 54 and 84. When longitudinal axis 66, of passageway 48, 62, and 76, including the longitudinal axes of openings 50, 64, 74 and 72 are aligned angularly with longitudinal axis 82, solid portion 86, of body 12, located intermediate spaced apart parallel passageways 56 and 70, is located adjacent end 88 of passageway 78, thereby blocking off visual access into passageway 78. In the position shown in FIG. 1, opening 38 is communicated with passageway 78 thereby allowing ready visual access into the interior of the furnace having both glass plates 54 and 84 spaced thereinbetween. If desired, body 12 may be lifted upwardly from opening 14, so as to remove body 12 for purposes of cleaning and/or maintenance, as required. Further, it is obvious that body 12 may be rotated about longitudinal axis 90 shown passing through protrusion 36 and bearing-like protrusion 42. Longitudinal axis 90 extends vertically outwardly from apex portion 28 and base portion 26 of body 12.

One of the advantages of the present invention is a peep sight for a furnace in which the user thereof is protected against injury in the event of the accidental breakage, cracking or deterioration of a sight glass.

Another advantage of the present invention is a double glass peep sight wherein both glasses are interposed between the interior of the furnace and the users eye, in a use position, thereby protecting the eyes of the user against injury.

Still another advantage of the present invention is a peep sight wherein the externally located sight glass is maintained close to the ambient temperature in which the user resides.

Yet another advantage of the present invention is a sight apparatus for furnaces wherein at least one glass is always located intermediate the interior of the furnace and the exterior thereof when a damaged glass is removed for replacement.

A further advantage of the present invention is a peep sight for furnaces which have the capability of placing a substantial thickness of metallic material between the interior and exterior of the furnace, closing off the interior of the furnace, when desired.

Another advantage of the present invention is a peep sight for furnaces which is inexpensive to manufacture, durable in construction, being fabricated from inexpensive materials and easily mounted to existent furnaces.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

I claim:

1. A furnace peep sight comprising a body having an upper surface, a lower surface, a surface of revolution, said upper surface and said lower surface being disposed in spaced apart relationship, said surface of revolution located intermediate said upper surface and said lower surface, said body having a longitudinal axis extending between said upper surface and said lower surface, a passageway, said passageway communicating between the ends thereof along a straight line, said ends of said passageway located in said surface of revolution, said body being journaled for rotation to a wall of a furnace along a longitudinal axis of said body, said longitudinal axis to said body passing through said upper surface and said lower surface, said furnace having another passageway therein, whereby said passageway may be coaxially aligned to said passageway of said furnace, said body having a pair of passageways therein communicating only to said upper surface, said pair of passageways each having a lining, said lining comprises a thermally insulating material, said lining defining an inner passageway therein, said lining having a pair of opposed openings therein, said pair of opposed openings juxtaposed with said passageway of said body, a cover plate, said cover plate removably affixed to said upper surface, said cover plate being disposed covering an opening to at least one of said pair of passageways of said body when said cover plate is affixed to said upper surface, said lining of each of said pair of passageways having a sight glass being disposed therein, whereby said pair of passageways of said body are disposed in spaced apart parallel relationship, and whereby said passageway of said body may be rotated having the longitudinal axis thereof out of coaxially alignment with said passageway of said furnace.

2. The apparatus as claimed in claim 1 wherein said furnace is provided having an opening therein, a portion of said body being disposed residing in said opening, another portion of said body extending outwardly from an exterior surface of said furnace.

3. The apparatus as claimed in claim 1 wherein said body comprises a truncated conical shape, the base of said truncated conical shape coinciding with said upper surface, the apex of said truncated shape coinciding with said lower surface.

4. The apparatus as claimed in claim 1 further comprising a protrusion, said protrusion being disposed on said upper surface.

5. The apparatus as claimed in claim 1 further comprising a protrusion, said protrusion being disposed located on said lower surface.

6. The apparatus as claimed in claim 1 wherein said body comprises steel.

7. The apparatus as claimed in claim 1 wherein the ends of said passageway of said body have a tapered shape adjacent that exterior surface of said surface of revolution of said body.

* * * * *